United States Patent [19]

Dinovo

[11] Patent Number: 4,920,549

[45] Date of Patent: Apr. 24, 1990

[54] TIME DEMAND COUNTER

[76] Inventor: John Dinovo, 4026 W. St. John, Glendale, Ariz. 85308

[21] Appl. No.: 153,260

[22] Filed: Feb. 8, 1988

[51] Int. Cl.[5] ..... G07C 5/02; G07C 3/02

[52] U.S. Cl. ..... 377/16; 377/15; 377/20; 368/8

[58] Field of Search ..... 377/15, 16, 20, 32; 368/8

[56] References Cited

U.S. PATENT DOCUMENTS

| | | | |
|---|---|---|---|
| 3,548,165 | 12/1970 | Linnenkamp | 377/15 |
| 3,729,620 | 4/1973 | Jones | 377/15 |
| 4,023,015 | 5/1977 | Garcia | 377/15 |
| 4,237,371 | 12/1980 | Le Bouder | 377/16 |
| 4,237,374 | 12/1980 | Malone | 377/15 |
| 4,262,842 | 4/1981 | Grover et al. | 377/20 |
| 4,630,292 | 12/1986 | Juricich et al. | 377/15 |

*Primary Examiner*—John S. Heyman
*Attorney, Agent, or Firm*—James F. Duffy

[57] ABSTRACT

A Time Demand Counter permits a sensor to be mechanically coupled, by quick connect/disconnect means, to the power feed line of a monitored device with little disruption of the power feed circuitry. The sensor is nonloading in that essentially no energy is drawn from the monitored device's feed line to power the Time Demand Counter. Unlike current transformers previously used, the sensor does not have to be varied to complement the current drawn by the monitored device. A long useful battery life is assured for internally powered embodiments of the invention. Also, since the invention accumulates the record of ON/OFF cycles, as well as the total accumulated demand time, the average time the monitored device is used each time demand is placed on it can be readily determined.

20 Claims, 1 Drawing Sheet

TIME DEMAND COUNTER

BACKGROUND

1. Field of the Invention

The invention relates to the scheduled maintenance of equipment and devices. In particular, the invention relates to the maintenance of equipment in accord with a schedule based on actual usage time of the equipment. Specifically, the invention relates to apparatus which indicates the total time in use of a given piece of equipment and/or the number of times a given piece of equipment is activated and deactivated. The average time a given piece of equipment is in use each time demand is made on it is determinable.

2. Prior Art

Machinery and equipment represent money invested. The return on that investment can be drastically reduced if the machinery and equipment are not maintained, or are too seldom maintained. However, the return on investment can also be adversely affected if the machinery and equipment are subjected to too frequent, unneeded maintenance.

An engine may have a preventive maintenance schedule which requires that the valve clearances be checked every 720 hours of operation. This check will require that the engine be taken off line and that maintenance personnel expend time and effort to perform the check. This particular check will be only one of many required by the 720 hour maintenance schedule, so the overall down-time and labor expenditure may be significant. This expenditure is wasteful if done too frequently, but is trivial if performed on a reasonable basis.

Engine manufacturer's recommendations provide a good starting point for setting a maintenance schedule. However, an ideal maintenance program is one tailored to the individual engine based on records kept from the date of installation of the engine. The problem that arises in attempting to establish such records is the uncertainty which generally exists as to how many hours of operation a particular engine has been subjected to. This is especially true of large manufacturing and power generating facilities where vast amounts of equipment are irregularly cycled on and off throughout the work day.

The need exists to ascertain the actual hours of operation each machine or other piece of equipment has experienced, on an on-going basis, so that a reasonable, near ideal, maintenance program for each machine might evolve. This need has been addressed in the prior art.

All the prior art known to the inventor herein is based on the general principle of detecting the initiation of line current feeding the machine being monitored for operational time. When the line current is detected, a time measuring and accumulating device is activated. When the line current falls to zero, the timing device is deactivated, but the record of accumulated operational time of the monitored equipment is retained for reference.

The need still exists, however, for a simple, inexpensive device which can be readily installed with minimal effort or disruption of the monitored equipment circuitry. Preferably, the device for measuring the time in which operation of a machine is demanded will be readily transportable and carry its own power source. It would also be beneficial if the time demand monitoring device yields information from which the average time of operation, per operation, might be derived. It is the inventor's intent to meet these needs, and more, with the Time Demand Counter taught herein.

SUMMARY OF THE INVENTION

In a time demand counter having sensing means for determining the activation of a device being monitored; timing means for timing and accumulating a record of total elapsed time of activation of a device being monitored; and, actuating means coupling the sensing means and the timing means for actuating the timing means when the device being monitored is itself activated and for deactuating the timing means when the device being monitored is not activated; the invention is disclosed and claimed as an improvement wherein the sensing means is a nonloading device so as to cause insignificant loading on the operation of a device being monitored.

The improvement further comprises a self contained power supply coupled to the time demand counter for energizing the time demand counter.

One of the embodiments of the invention discloses the improvement wherein the actuating means comprises a multivibrator triggered by a first signal output by the sensing means at the time of actuation of a monitored device and again triggered by a second signal output by the sensing means at the time of deactivation of a monitored device. The sensing means may comprise a Hall effect device.

The improvement is disclosed as further comprising counter means coupled to the actuating means and actuated thereby for counting and accumulating a record of the number of times a device being monitored has been actuated. This embodiment also may include a self contained power supply.

The improvement is also set forth wherein the actuating means further comprises signal conditioning means for establishing the proper amplitude, polarity, and shape of the signals from the sensing means triggering the multivibrator. If the sensing means outputs an alternating level signal when a monitored device is activated, then the signal conditioning means provides means for converting the alternating level signal to a constant level signal.

Another embodiment discloses the improvement wherein the actuating means comprises a processor having means programmed to detect a first signal from the sensing means indicative of actuation of a monitored device and again detecting a second signal from the sensing device indicative of the nonactivation of a monitored device. The processor further comprises means programmed to energize the Hall effect device sensor from the self contained power supply at selected periods of time of duration selected to increase the useful service life of the self contained power supply relative to the service life that would obtain if the Hall effect device sensor were continually energized.

The improvement is claimed wherein the sensing means is a Hall effect device and further comprises quick connect/disconnect means for coupling the sensing means to a power line feeding energy to a device being monitored. There are means coupled to the Hall effect device for energizing it at a low duty cycle sampling rate to reduce the average power required to energize the Hall effect device over a selected period of time.

DETAILS OF THE INVENTION

Figure 1:
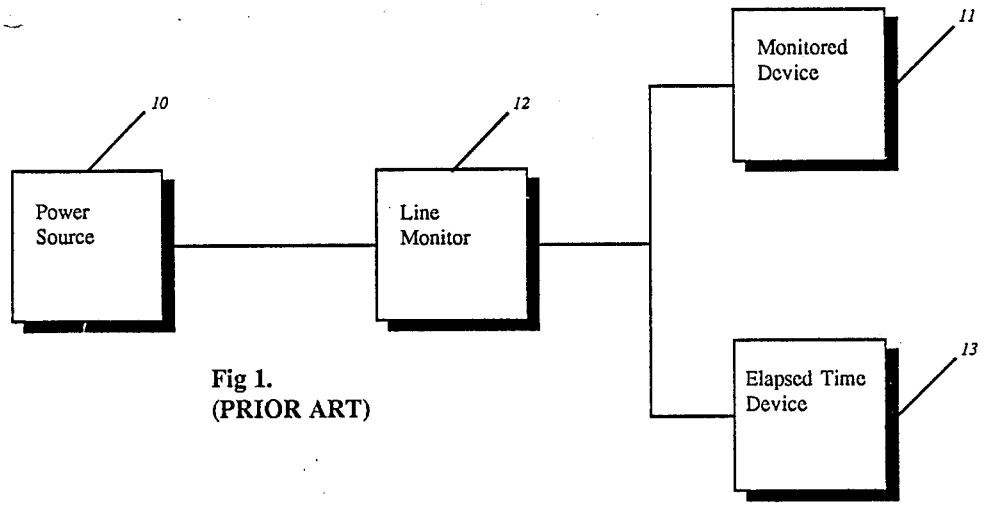
Fig 1. (PRIOR ART)
FIG. 1 is a block diagram illustrating the prior art method of monitoring equipment usage in which the timing device draws its power from the line source of the monitored device.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention partains.

In FIG. 1, the manner in which many prior art monitoring devices worked is set out in block diagram format. A power source 10 is employed to energize a device 11. Since the need existed to determine the total time device 11 was activated, a timing device 13, perhaps a simple clock mechanism, was energized and de-energized simultaneously with the monitored device 11.

In order to achieve the simultaneous activation / deactivation of both timer 13 and device 11, a line monitor 12 was used to to sample the current flowing to the monitored device 11. The sampled portion of the current was used to energize timer 13. Thus, timer 13 was forced ON and OFF each time device 11 was activated and deactivated.

Timer 13 is an accumulating device which presents the total time that demand was made on monitored device 11. Because actual line current was used to activate timer 13, the electrical hook up of the equipment required to marry the timer 13 and the monitored device 11 together was often time consuming and involved line transformers and the like to draw off the energy required to activate timer 13.

Figure 2:
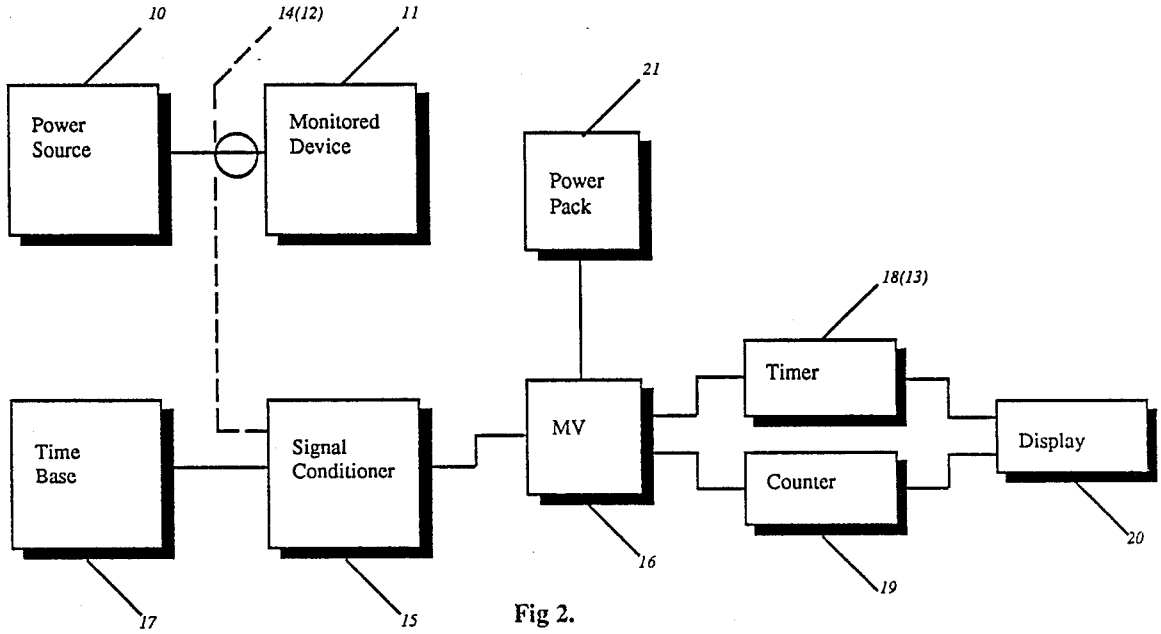
FIG. 2 is a block diagram of a self powered monitoring device.

The embodiment of the invention set out in FIG. 2 does not draw off energy for its activation from the power lines feeding monitored device 11. In FIG. 2, a line sensor 14 provides the line monitoring function of monitor 12 in FIG. 1. However, unlike monitor 12 which draws off line current to energize elapsed time device 13, line sensor 14 simply reacts to the presence of current flow in the lines feeding monitored device 11. The reaction of sensor 14 to line current in the feed lines is a signal sent to signal conditioner 15. The nature of the signal may be, for example, a change in the status of sensor 14.

By way of illustration and not of limitation, assume that sensor 14 is a Hall effect device. With respect to conductors such as the power lines feeding monitored device 11, Hall effect is defined as the change of the electrical conduction caused by that componant of the magnetic field vector normal to the current density vector, which, instead of being parallel to the electric field, forms an angle with it. A Hall effect device is further defined as a device in which the Hall effect is utilized. (ANSI/IEEE Std 100-1977.)

Still assuming that line sensor 14 is a Hall effect device, it will react to the magnetic field created when current flows through the power line conductors connecting power source 10 to monitored device 11. This reaction will take the form of a change of electrical conduction through sensor 14. That electrical conduction itself is derived from power pack 21, either a line source or a self contained power source, e.g. a battery pack, for powering the invention, the Time Demand Counter.

The change in electrical conduction of sensor 14 may be treated as a 1/0, two state digital signal and used to trigger a monostable, or flip-flop, multivibrator (MV) 16. The signal is first conditioned, in manner well known to the art, by signal conditioner 15 so that a trigger of proper shape, amplitude and polarity is input to MV 16 causing MV 16 to change its operating state.

The situation, to this point will be satisfactory if power source 10 is a dc source. However, if source 10 is an ac source, provision must be made to keep cyclical alternations of line current from being reflected as a cyclical train of triggers applied to MV 16, causing it to change its operative condition in synch with the frequency of the line current. Time base 17 obviates this potential problem.

Time base 17 is a part of signal conditioner 15 and operates effectively as an ac filter. Time base 17, in a basic form, is an RC circuit whose RC time constant maintains the signal constant, relative to the fluctuating ac line current. Thus, the trigger applied to MV 16 always represents a Hall effect change of electrical conduction unrelated to the ac frequency of operation of the line current from power source 10.

When a change of state of sensor 14 occurs, such as a change in the electrical conduction of a Hall effect device, that status change provides a signal to MV 16, via signal conditioner 15 and time base 17. The signal is a trigger output from signal conditioner 15 to change the operative status of MV 16. If sensor 14 detected current flow in the feed lines from power source 10, then MV 16 will operate so as to output a signal to timer 18 to accumulate and store the total time timer 18 is, and has been, actuated. Actuated, that is, in the present instance as well as all previous periods of actuation. The total time accumulated by timer 18 is made available for display on display 20, for example a liquid crystal display.

When the current flow from source 10 to device 11 ceases, sensor 14 will experience another change in electrical conduction therethrough. This change is indicative of a non-operative condition of device 11. This change will also result in a retriggering of MV 16 to revert it to its former state and remove the actuation signal from timer 18. Timer 18 will then stop accumulating time. In this manner, the total time accumulated by timer 18 coincides with the total time of operation of monitored device 11 since the time sensor 14 was first coupled to the feed lines from source 10 to device 11.

At the time MV 16 outputs an actuating signal to timer 18, it also outputs a signal to counter 19 to advance one count and to store the total number of counts made and accumulated therein. This total count coincides with the total number of times monitored device 11 has been placed into service since the installation of sensor 14. (It is readily understood that the same results can be derived by counting each instance in which the demand on monitored device 11 was terminated.) The accumulated count is made available for presentation on display 20. Display 20 may comprise individual timer and counter displays or may selectively display one or the other on a single display.

The Time Demand Counter of FIG. 2 functions best with a sensor 14 which places minimal demand on a self contained power pack 21. Ideally, there would be little or no current drain on power pack 21 until such time as sensor 14 reacts to current flowing in the feed lines between source 10 and device 11. This ideal cannot be approached using a Hall effect device as sensor 14 since, by definition, the Hall effect device must be maintained in conduction in order that a change in the level of electrical conduction might herald a service demand for monitored device 11. The Time Demand Counter of FIG. 2, using a Hall effect device as sensor 14 is, thus, not a presently preferred embodiment, although it is believed to be innovative and available for use in situations where considerations, such as battery drain, are of small concern, or in embodiments wherein a self-contained power source is not a necessity.

While still actively searching for the near ideal sensor 14, the inventor herein has sought to overcome the battery draining, current demand requirements of a Hall effect device used as a line sensor. The results are disclosed in the presently preferred embodiment of the Time Demand Counter depicted in FIG. 3.

Figure 3:
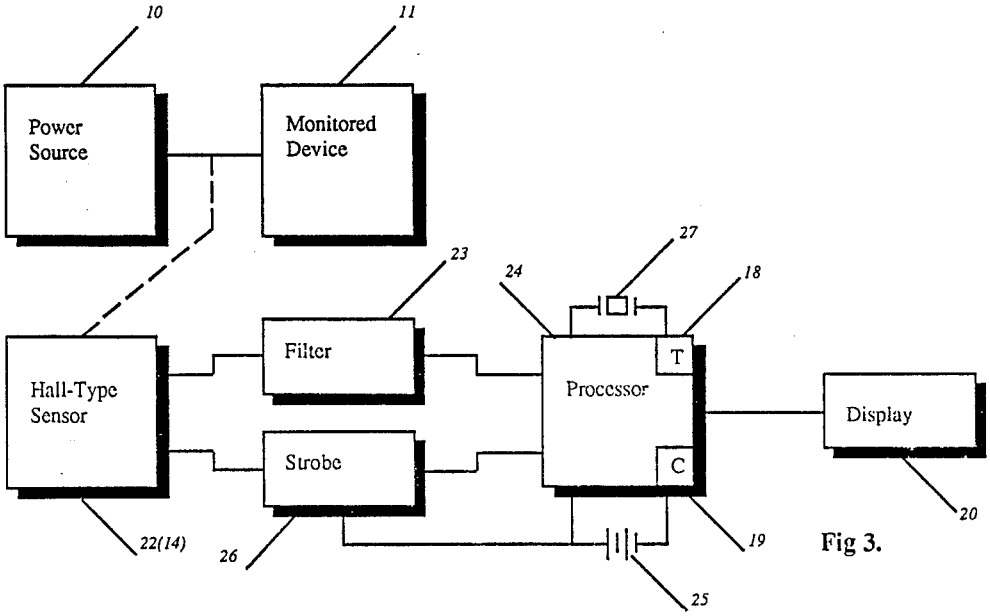
FIG. 3 is a block diagram of a power economizing monitoring device.

In FIG. 3, sensor 14 is more specifically disclosed as a sensor which, because of its current drawing requirements, adversely affects the useful life of a self contained power source, e.g. battery 25. Because sensor 14, in FIG. 3, must be in a state of conduction to function properly as a sensor, it is here exemplified as Hall-type (HT) sensor 22. In a manner similar to the operation of the invention embodied in FIG. 2, when monitored device 11 is activated, HT sensor 22 senses the flow of current between power source 10 and device 11 and signals processor 24, as, for example, by change of its conduction state, that a demand has been made on device 11. Filter 23, like time base 17, obviates the flow of an erroneous chain of signals from HT sensor 22 in the event that ac current is energizing device 11.

Processor 24 is programmed to activate timer 18 when the signal from HT sensor indicates that device 11 is on demand. Timer 18 accumulates a record of the running time of device 11. The amount of time accumulated is available for display on display 20. Processor 24 is also programmed to activate counter 19 to record and accumulate the number of times demand is made of device 11. The functioning of timer 18 and counter 19, as well as display 20, are as previously indicated in discussing FIG. 2.

An important feature of the programming of processor 24 is the control of the energization path between battery 25 and HT sensor 22. Since it is the constant drain on the battery power source that limits the usefulness of Hall-type devices in internally powered equipment, processor 24 provides that the conduction drain of HT sensor 22 is intermittent rather than constant. Indeed, processor 24 is programmed to significantly reduce current drain on battery 25 by controlling the duty cycle of conduction of HT sensor 22.

Assume that when HT sensor 22 is conducting a status signal of digital level 1 is presented by the sensor to processor 24 when NO demand is being made on device 11; and that a level 0 is presented when demand IS made. Processor 24 need not detect the moment that the status of HT sensor 22 changes from 1 to 0, but only the absolute level to determine whether demand is being made of device 11 and whether timer 18 is to be activated or not. Thus, it is possible to bring HT sensor 22 into conduction for selected short intervals of time to determine whether or not device 11 is on demand during that interval. By interspersing short intervals of conduction with relatively long intervals of non-conduction, the useful life of battery 25 in the embodiment of the invention in FIG. 3 is dramatically extended.

Let it be assumed that HT sensor 22 achieves stable conduction within one millisecond. If it were then activated for 1 ms and deactivated for 1 sec., the duty cycle would be 0.001 and the useful life of battery 25 in the circuit might be increased almost 1000 times. To this end, processor 24 is programmed to activate power strobe 26 at, e.g. 1 sec. intervals. The period of activation might be 1 ms. During that 1 ms, strobe 26 acts to connect battery 25 to HT sensor 22 to draw the sensor into conduction.

Also during that 1 ms, prosessor 24 determines whether sensor 22 is at status level 1 or 0. If status level 1 is determined, neither timer 18 nor counter 19 is activated by the processor. If, on the other hand, a status level of 0 is determined, the timer and counter are activated. In this latter instance, timer 18 will continue to accumulate a record of time that demand is made on device 11 until, in one of the 1 ms periods in which HT sensor 22 is in conduction, processor 24 determines that sensor 22 is at status level 1. When status level 1 is determined, counter 18 is deactivated by processor 24.

For functional precision, program timing of processor 24 is controlled by crystal 27.

Statistically there should be little or no error introduced into the record of the time accumulated by timer 18 as a result of the sampling technique implied here. In addition, the invention permits a sensor to be mechanically coupled, by quick connect/disconnect means, to the power feed line of a monitored device with little disruption of the power feed circuitry. The sensor is nonloading in that essentially no energy is drawn from the monitored device's feed line to power the Time Demand Counter. Unlike current transformers previously used, the sensor does not have to be varied to complement the current drawn by the monitored device. A long useful battery life is assured for internally powered embodiments of the invention. Also, since the invention accumulates the record of ON/OFF cycles, as well as the total accumulated demand time, the average time the monitored device is used each time demand is placed on it can be readily determined.

What has been disclosed is a Time Demand Counter coupled in a nonloading manner to the power feed lines of a monitored device. AC and DC operation is permitted. Data re average ON time as well as total ON time of the monitored device is accumulated. Self contained operation with an internal battery pack is practical.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, That which is claimed is:

1. In a time demand counter having current sensing means for detecting, by current flow, the actuation of a device being monitored;

timing means for timing and accumulating a record of total elapsed time of actuation of a device being monitored; and actuating means coupling said sensing means and said timing means for actuating said timing means when the device being monitored it itself activated and for dectuating said timing means when the device being monitored is not activated;

the improvement wherein:

said current sensing means is a nonloading device so as to cause insignificant loading on the operation of a device being monitored.

2. The improvement of claim 1 further comprising a self contained power supply coupled to said time demand counter for energizing said time demand counter.

3. The improvement of claim 1 wherein said actuating means comprises a multivibrator triggered by a first signal output by said sensing means at the time of actuation of a monitored device and again triggered by a second signal output by said sensing means at the time of deactivation of a monitored device.

4. The improvement of claim 3 wherein said sensing means comprises a Hall effect device.

5. The improvement of claim 4 further comprising counter means coupled to said actuating means and actuated thereby for counting and accumulating a record of the number of times a device being monitored has been actuated.

6. The improvement of claim 5 further comprising a self contained power supply coupled to said time demand counter for energizing said time demand counter.

7. The improvement of claim 3 further comprising counter means coupled to said actuating means and actuated thereby for counting and accumulating a record of the number of times a device being monitored has been actuated.

8. The improvement of claim 7 wherein said sensing means comprises a Hall effect device.

9. The improvement of claim 8 wherein said actuating means further comprises signal conditioning means for establishing the proper amplitude, polarity, and shape of the signals from said sensing means triggering said multivibrator.

10. The improvement of claim 9 wherein said sensing means outputs an alternating level signal when a monitored device is activated, and said signal conditioning means further comprises means for converting said alternating level signal to a constant level signal.

11. The improvement of claim 10 further comprising a self contained power supply coupled to said time demand counter for energizing said time demand counter.

12. The improvement of claim 1 wherein said actuating means comprises a processor having means programmed to detect a first signal from said sensing means indicative of actuation of a monitored device and again detecting a second signal from said sensing device indicative of the nonactivation of a monitored device.

13. The improvement of claim 12 wherein said sensing means comprises a Hall effect device.

14. The improvement of claim 13 further comprising counter means coupled to said processor and actuated thereby, when a monitored device has been activated, for counting and accumulating a record of the number of times a device being monitored has been activated.

15. The improvement of claim 13 further comprising a self contained power supply coupled to said time demand counter for energizing said time demand counter under control of said processor.

16. The improvement of claim 15 wherein said processor further comprises means programmed to energize said Hall effect device sensor from said self contained power supply at selected periods of time of duration selected to increase the useful service life of said self contained power supply relative to the service life that would obtain if said Hall effect device sensor were continually energized.

17. The improvement of claim 16 further comprising counter means coupled to said processor and actuated thereby, when a monitored device has been activated, for counting and accumulating a record of the number of times a device being monitored has been activated.

18. The improvement of claim 1 wherein said sensing means further comprises quick connect/disconnect means for coupling said sensing means to a power line feeding energy to a device being monitored.

19. The improvement of claim 18 wherein said sensing means comprises a Hall effect device.

20. The improvement of claim 19 further comprising means coupled to said Hall effect device for energizing it at a low duty cycle sampling rate to reduce the average power required to energize said Hall effect device over a selected period of time.

* * * * *